US008960957B2

(12) United States Patent
Long

(10) Patent No.: US 8,960,957 B2
(45) Date of Patent: Feb. 24, 2015

(54) LED LAMP HAVING A LENS MOUNTED THROUGH CONNECTION RODS AND A HOOK

(71) Applicants: Shenzhen BYD Auto R&D Company Limited, Shenzhen (CN); BYD Company Limited, Shenzhen (CN)

(72) Inventor: Feihong Long, Shenzhen (CN)

(73) Assignees: Shenzhen BYD Auto R&D Company Limited, Shenzhen (CN); BYD company Limited, Shenzhen (CN)

( * ) Notice: Subject to any disclaimer, the term of this patent is extended or adjusted under 35 U.S.C. 154(b) by 0 days.

(21) Appl. No.: 13/930,491

(22) Filed: Jun. 28, 2013

(65) Prior Publication Data

US 2014/0003058 A1 Jan. 2, 2014

(30) Foreign Application Priority Data

Jun. 28, 2012 (CN) ..... 2012 2 0305850
Nov. 26, 2012 (CN) ..... 2012 1 0486113

(51) Int. Cl.

| | |
|---|---|
| ***F21S 4/00*** | (2006.01) |
| ***F21V 21/00*** | (2006.01) |
| ***F21V 5/04*** | (2006.01) |
| ***F21K 99/00*** | (2010.01) |
| ***F21V 17/10*** | (2006.01) |
| *F21V 29/00* | (2006.01) |
| *F21Y 101/02* | (2006.01) |

(52) U.S. Cl.

CPC ... *F21V 5/04* (2013.01); *F21K 9/30* (2013.01); *F21K 9/137* (2013.01); *F21V 17/10* (2013.01); *F21V 29/246* (2013.01); *F21Y 2101/02* (2013.01)

USPC ..... 362/249.02; 362/373; 362/455

(58) Field of Classification Search

CPC ..... F21V 5/04; F21V 29/246; F21V 17/10; F21K 9/30; F21K 9/137; F21Y 2101/02

USPC ..... 362/249.02, 294, 455, 373, 547, 345; 257/98; 313/45, 46

See application file for complete search history.

(56) References Cited

U.S. PATENT DOCUMENTS

| | | | | |
|---|---|---|---|---|
| 7,828,464 | B2 * | 11/2010 | Wang et al. | 362/294 |
| 2009/0103296 | A1 * | 4/2009 | Harbers et al. | 362/234 |
| 2010/0212859 | A1 * | 8/2010 | Liang | 165/47 |
| 2011/0317428 | A1 * | 12/2011 | Paik et al. | 362/294 |
| 2012/0195053 | A1 | 8/2012 | Wu | |
| 2013/0208472 | A1 * | 8/2013 | Nishimori et al. | 362/244 |
| 2013/0301259 | A1 * | 11/2013 | Ahn | 362/235 |
| 2014/0063809 | A1 * | 3/2014 | Huang, Yaote | 362/294 |

FOREIGN PATENT DOCUMENTS

| | | | |
|---|---|---|---|
| CN | 202024257 | U | 11/2011 |
| CN | 102378466 | A | 3/2012 |
| WO | 2007128070 | A1 | 11/2007 |
| WO | WO 2012066796 | A1 * | 5/2012 |

* cited by examiner

*Primary Examiner* — Anh Mai
*Assistant Examiner* — Glenn Zimmerman
(74) *Attorney, Agent, or Firm* — David D. Brush; Westman, Champlin & Koehler, P.A.

(57) ABSTRACT

An LED lamp is provided. The LED lamp includes a heat radiation member having a cavity therein; an LED module disposed in the cavity; a mounting frame disposed in the cavity and being above the LED module; and a lens mounted on the mounting frame.

20 Claims, 9 Drawing Sheets

LED LAMP HAVING A LENS MOUNTED THROUGH CONNECTION RODS AND A HOOK

CROSS-REFERENCE TO RELATED APPLICATIONS

This application claims priority and benefits of the following applications:

1) Chinese Patent Application No. 201210486113.8 filed with State Intellectual Property Office, P. R. C. on Nov. 26, 2012; and 2) Chinese Patent Application No. 201220305850.9 filed with State Intellectual Property Office, P. R. C. on Jun. 28, 2012.

The entire contents of the above applications are incorporated herein by reference.

FIELD

Embodiments of the present disclosure generally relate to an LED lamp.

BACKGROUND

A lens of a conventional LED lamp is mounted on a heat radiation member. The lens is a plastic member, and the heat radiation member is made of metal. Because the deformation of the heat radiation member is very small, a deformation of a hook of the lens should be large so as to mount the lens on the heat radiation member. If a thickness of the hook of the lens is large, the deformation of the hook of the lens will be small. If the thickness of the hook of the lens is small, the hook of the lens will be broken when the lens is mounted. Moreover, because a thickness of a body of the lens is large, the hook of the lens shall have a predetermined thickness so as to meet requirements of injection molding. Thus, the lens of the conventional LED lamp is difficult to mount.

SUMMARY

Embodiments of the present disclosure provide an LED lamp, comprising a heat radiation member having a cavity therein; an LED module disposed in the cavity; a mounting frame disposed in the cavity and being above the LED module; and a lens mounted on the mounting frame.

With the LED lamp according to embodiments of the present disclosure, the mounting frame is disposed in the cavity and the lens is mounted on the mounting frame, so that the lens is mounted on the heat radiation member by means of the mounting frame. Therefore, the lens is prevented from deformation and damage caused by direct mounting of the lens on the heat radiation member, and the difficulty of mounting the lens can be reduced. Therefore, The LED lamp according to embodiments of the present disclosure can be easier to assemble and has long service life.

DETAILED DESCRIPTION

Figure 1:
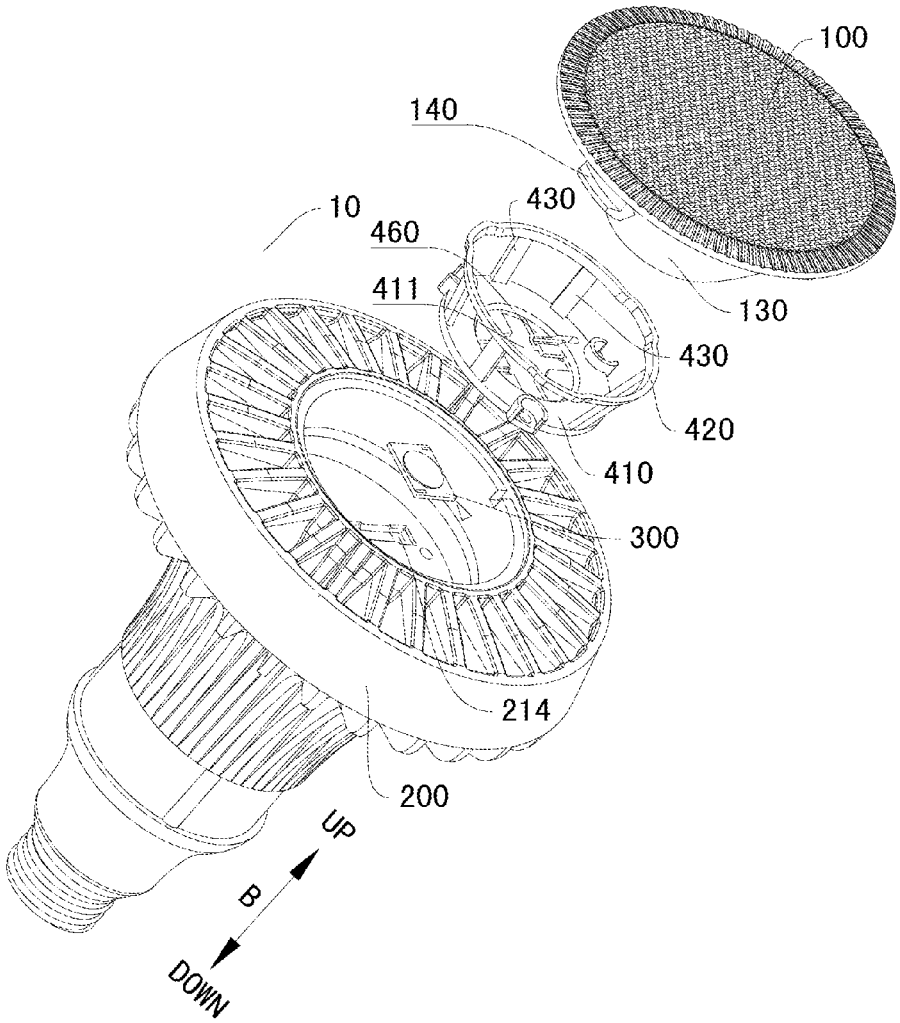
FIG. 1 is an exploded view of an LED lamp according to an embodiment of the present disclosure.

Referring to the drawings, embodiments of the present disclosure will be described by way of example only.

Unless specified or limited otherwise, terms concerning attachments, coupling and the like, such as "mounted," "connected," "supported," and "coupled" and variations thereof are used broadly and encompass both direct and indirect mountings, connections, supports, and couplers. Further, "connected" and "coupled" are not restricted to physical or mechanical connections or couplers.

In the specification, relative terms such as "central", "longitudinal", "lateral", "front", "rear", "right", "left", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

The LED lamp 10 according to embodiments of the present disclosure will be described below with reference to FIGS. 1 to 9. As shown in FIGS. 1 to 9, the LED lamp 10 according to embodiments of the present disclosure comprises a heat radiation member 200, an LED module 300, a mounting frame 400 and a lens 100.

The heat radiation member 200 has a cavity 210 therein, and the LED module 300 is disposed in the cavity 210. The mounting frame 400 is disposed in the cavity 210 and the mounting frame 400 is above the LED module 300. The lens 100 is mounted on the mounting frame 400.

With the LED lamp 10 according to embodiments of the present disclosure, the mounting frame 400 is disposed in the cavity 210 and the lens 100 is mounted on the mounting frame 400, so that the lens 100 is mounted on the heat radiation member 200 by means of the mounting frame 400. Therefore, the lens 100 is prevented from deformation and damage caused by direct mounting of the lens 100 on the heat radiation member 200, and the difficulty of mounting the lens 100 can be reduced. Therefore, The LED lamp 10 according to embodiments of the present disclosure can be easier to assemble and has long service life.

Figure 2:
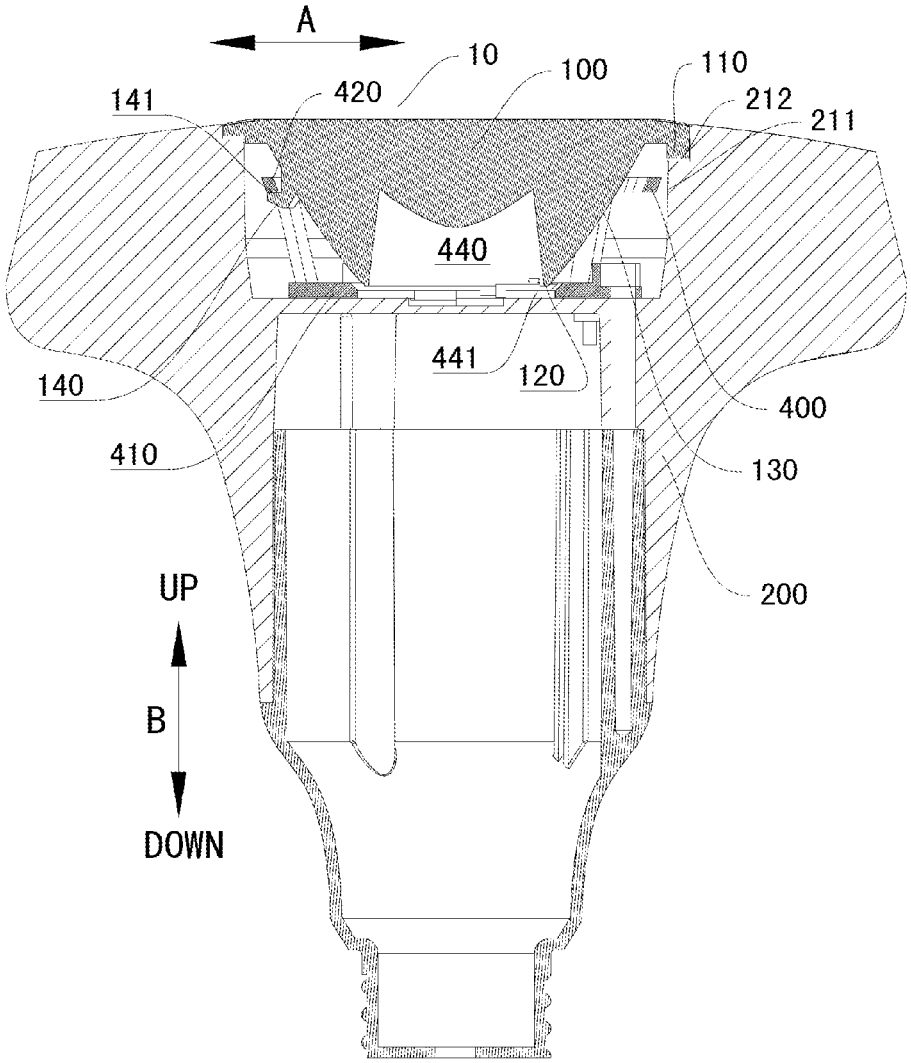
FIG. 2 is a sectional view of an LED lamp according to an embodiment of the present disclosure.
Figure 3:
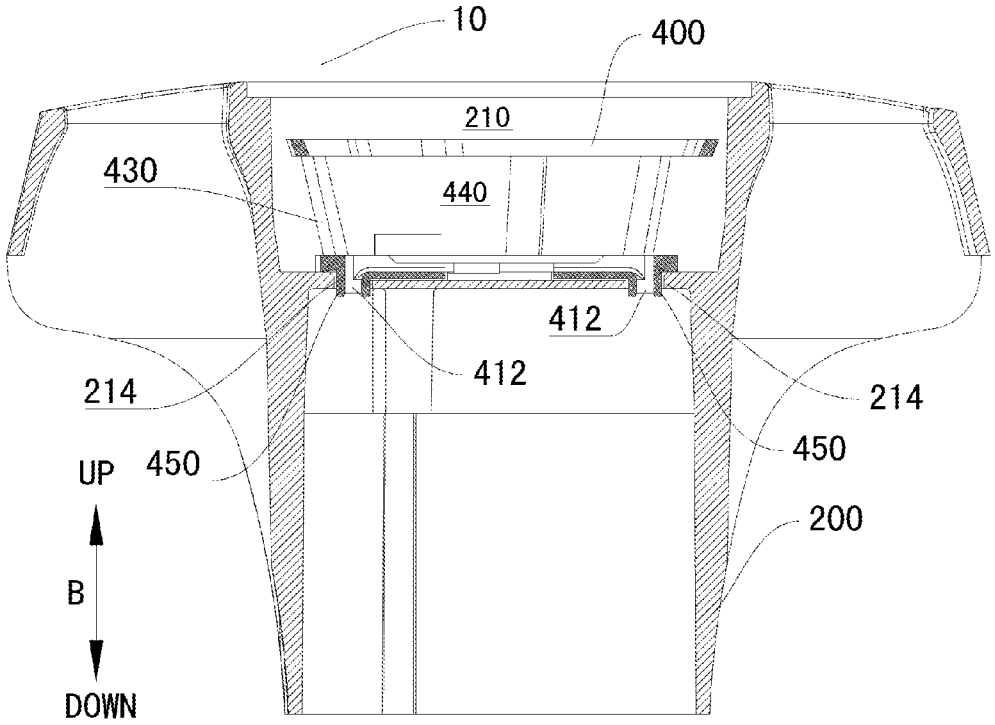
FIG. 3 is a partial sectional view of an LED lamp according to an embodiment of the present disclosure.
Figure 4:
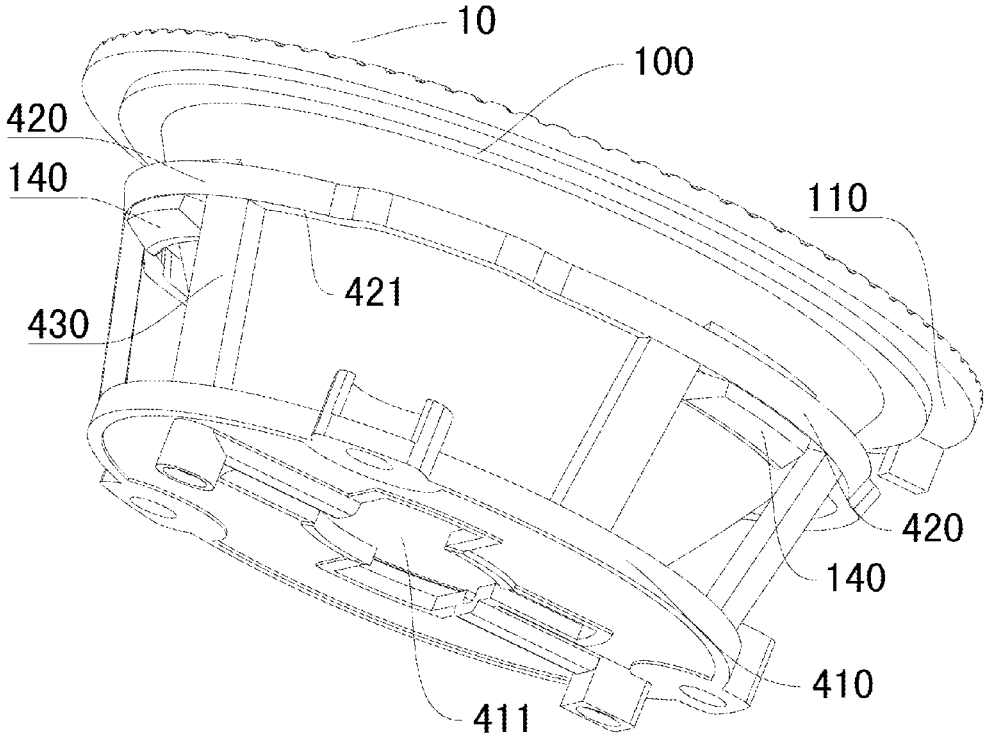
FIG. 4 is a partial perspective view of an LED lamp according to an embodiment of the present disclosure.

As shown in FIGS. 2 to 4, in some embodiments, the mounting frame 400 has a mounting cavity 440 therein, and the lens 100 is mounted in the mounting cavity 440. Thus, the lens 100 is more firmly mounted on the mounting frame 400.

In some embodiments, a hook 140 for catching the mounting frame 400 so as to mount the lens 100 on the mounting frame 400, is disposed on an outer circumferential surface 130 of the lens 100. Thus, the lens 100 can be more easily and firmly mounted on the mounting frame 400.

As shown in FIGS. 1 and 3 to 7, in some embodiments, the mounting frame 400 comprises an upper ring 420, a bottom plate 410 and a plurality of connection rods 430. The bottom plate 410 has a through slot 411 penetrated therethrough along an up and down direction. Each connection rod 430 has an upper end connected with the upper ring 420 and a lower end connected with the bottom plate 410, the plurality of connection rods 430 are spaced apart from each other along a circumferential direction of the mounting frame 400, and the hook 140 is inserted between adjacent connection rods 430 so as to catch the upper ring 420. Thus, a structure of the mounting frame 400 is simple and reasonable and so on. Moreover, the lens 100 can be more expediently, fleetly, firmly and detachably mounted on the mounting frame 400.

In some embodiments, the mounting frame 400 is substantially configured as a hollow bowl. The bottom plate 410 is mounted on the bottom wall 213 of the cavity 210 via a bolt.

The number of the connection rods 430 is six. A hook groove is formed between adjacent connection rods 430 and the upper ring 420, and the hook 140 catches the hook groove. Advantageously, the hook 140 is V-shaped. Thus, the hook 140 can catch the upper ring 420 more firmly.

Figure 8:
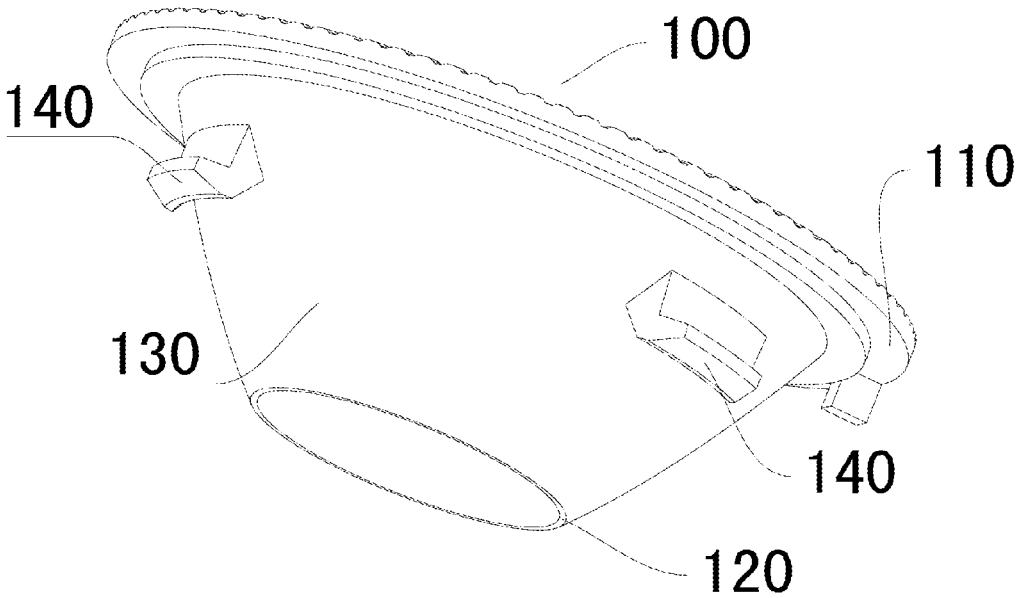
FIG. 8 is a schematic perspective view of a lens of an LED lamp according to an embodiment of the present disclosure.

As shown in FIG. 8, a plurality of the hooks 140 are provided and are evenly spaced apart from each other along a circumferential direction of the lens 100. Thus, the lens 100 is more firmly mounted on the mounting frame 400.

In some embodiments, the hook 140 is integrally formed with the lens 100, thus reducing the manufacturing cost of the LED lamp 10. The plurality of the connection rods 430, the upper ring 420 and the bottom plate 410 are integrally formed from a plastic material, thus enhancing the structural strength of the mounting frame 400 and reducing the manufacturing cost of the mounting frame 400.

In some embodiments, the hook 140 abuts against each of the adjacent connection rods 430. Thus, the adjacent connection rods 430 can clamp the hook 140 tightly, so that the lens 100 is more firmly mounted on the mounting frame 400.

The hook 140 catches a lower surface 421 of the upper ring 420. A contact surface 141 of the hook 140 contacting the lower surface 421 of the upper ring 420, a bottom surface 120 of the lens 100 and the bottom plate 410 are parallel with one another. Thus, the lens 100 is more firmly mounted on the mounting frame 400.

As shown in FIG. 2, in some embodiments, a bottom surface 120 of the lens 100 is spaced apart from a bottom wall 441 of the mounting cavity 440 by a predetermined distance. Thus, there is larger space between the mounting frame 400 and the lens 100, thus preventing a wire of the LED module 300 from being pressed by the lens 100. Moreover, even if the lens 100 is not mounted in place, the lens 100 can be moved downwards so as to mount the lens 100 on the mounting frame 400.

In some embodiments, as shown in FIGS. 2-4, a groove 212 is formed in a circumferential wall 211 of a top end of the cavity 210, an upper end of the lens 100 is upwardly extended out of the mounting cavity 440, and an outer circumferential edge of the upper end of the lens 100 is fitted in the groove 212. Thus, the lens 100 is more firmly mounted. Moreover, even if the lens 100 is not mounted in place, the lens 100 can be moved downwards by increasing the depth of the groove 212 so as to mount the lens 100 on the mounting frame 400.

As shown in FIG. 2, in some embodiments, the upper end of the lens 100 has a flange 110 extended along a radial direction and fitted in the groove 212. Thus, the lens 100 is more firmly mounted. The radial direction is shown by an arrow A in FIG. 2.

Figure 9:
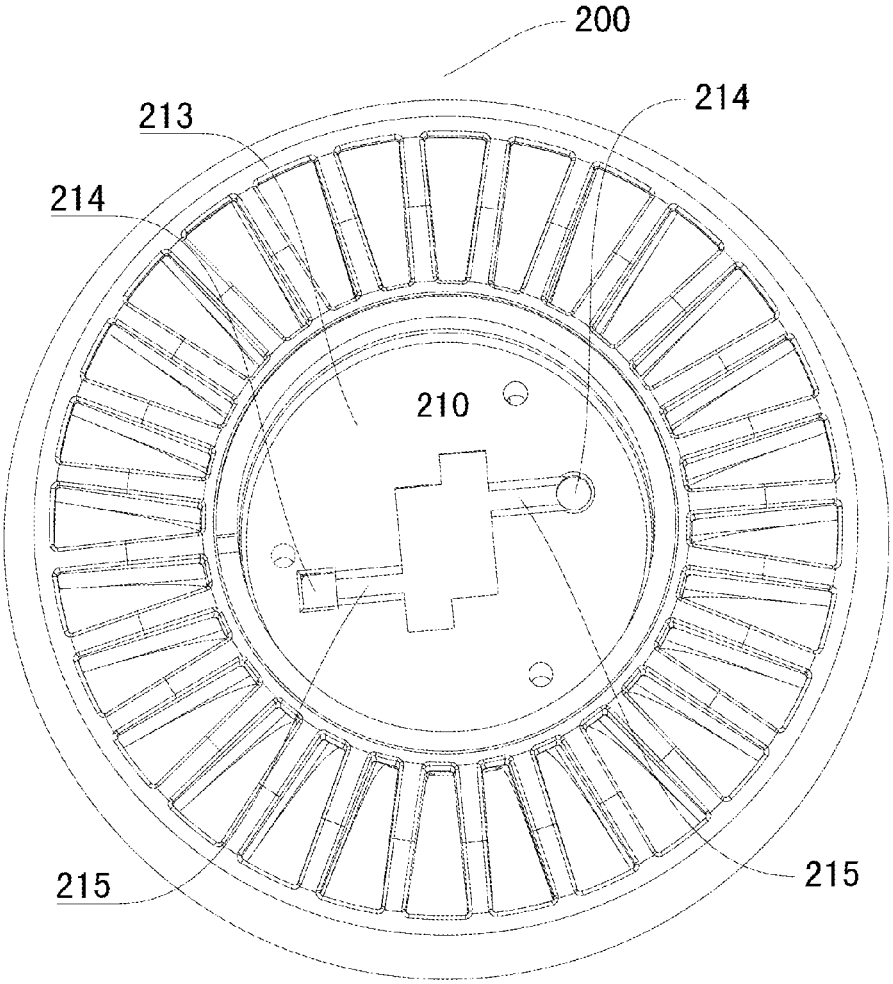
FIG. 9 is a schematic perspective view of a heat radiation member of an LED lamp according to an embodiment of the present disclosure.

As shown in FIGS. 3 and 9, a first wire hole 214 is formed in the bottom wall 213 of the cavity 210 and penetrated therethrough in an up and down direction. A second wire hole 412 is formed in the bottom plate 410, penetrated therethrough in the up and down direction and corresponded to the first wire hole 214. A first wire groove 413 is formed in an upper surface 418 of the bottom plate 410 and has an end communicated with the second wire hole 412. The up and down direction is shown by an arrow B in FIGS. 1 to 3.

The heat radiation member 200 is usually made of a metal such as an aluminum alloy, so as to facilitate to heat radiation. The most part of the wire is prevented from contacting with the heat radiation member 200 by forming the second wire hole 412 corresponded to the first wire hole 214 and the first wire groove 413 communicated with the second wire hole 412 in the bottom plate 410. Thus, a scarfskin of the wire is prevented from deformation and accelerated aging, and therefore the short circuit caused by the desquamation of the scarfskin of the wire can be avoided, thus improving the service life and security of the LED lamp 10.

Figure 5:
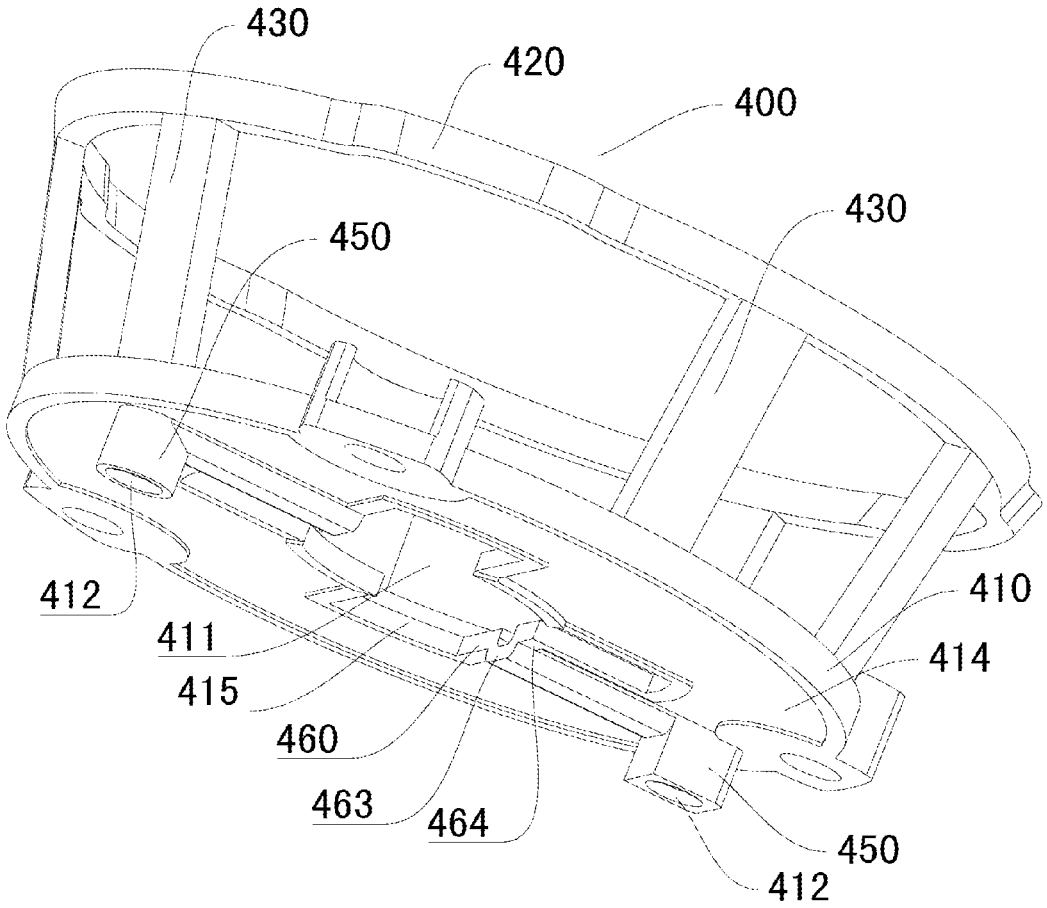
FIG. 5 is a schematic perspective view of a mounting frame of an LED lamp according to an embodiment of the present disclosure.
Figure 6:
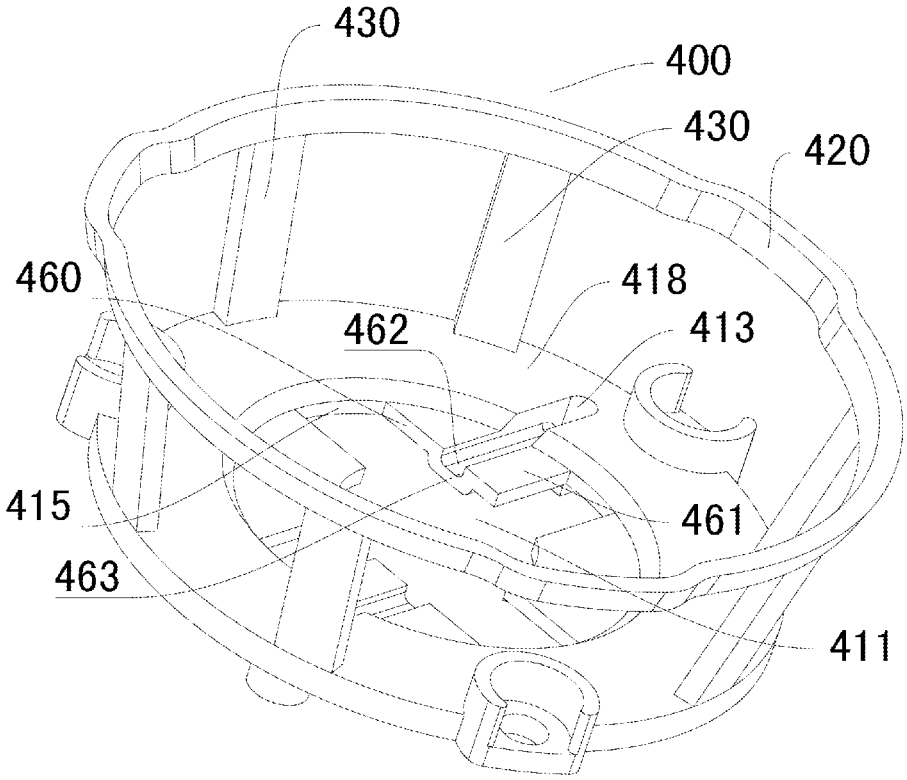
FIG. 6 is a schematic perspective view of a mounting frame of an LED lamp according to an embodiment of the present disclosure.
Figure 7:
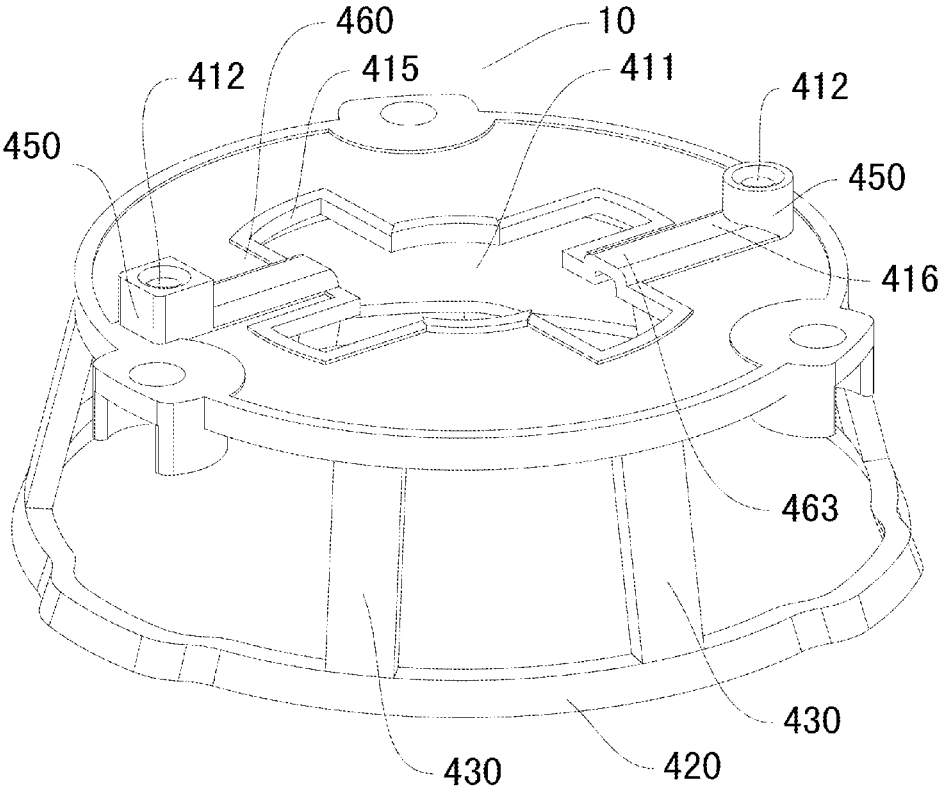
FIG. 7 is a schematic perspective view of a mounting frame of an LED lamp according to an embodiment of the present disclosure.

In some embodiments, as shown in FIGS. 3 to 5, a column 450 is disposed on a lower surface 414 of the bottom plate 410 and fitted within the first wire hole 214, and the second wire hole 412 is penetrated through the column 450. Thus, the most part of the wire is prevented from contacting with the heat radiation member 200, thus improving the service life and security of the LED lamp 10.

As shown in FIGS. 1, 5 to 7, in some embodiments, a wire passing extension 460 is disposed on an inner wall 415 of the bottom plate 410 and extended towards a center of the bottom plate 410. A second wire groove 462 is formed in an upper surface 461 of the wire passing extension 460 and communicated with the first wire groove 413. Thus, the entire wire is prevented from contacting with the heat radiation member 200, thus further improving the service life and security of the LED lamp 10.

In some embodiments, as shown in FIGS. 3 to 5, 9, a holding groove 215 is formed in the bottom wall 213 of the cavity 210.

A portion of the bottom plate 410 is recessed downwardly with respect to a remaining portion of the bottom plate 410 so as to form a first boss 416 on a lower surface 414 of the bottom plate 410 and to form the first wire groove 413. A portion of the wire passing extension 460 is recessed downwardly with respect to a remaining portion of the wire passing extension 460 so as to form a second boss 463 on a lower surface 464 of the wire passing extension 460 and to form the second wire groove 462.

The first boss 416 and the second boss 463 are received in the holding groove 215. Thus, a thickness of the bottom plate 410 and a thickness of the wire passing extension 460 are not changed, thus improving the structural strength of the mounting frame 400.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. An LED lamp, comprising:

a heat radiation member defining a cavity therein;

an LED module disposed in the cavity;

a mounting frame disposed in the cavity and being above the LED module;

a lens mounted on the mounting frame, comprising:

an upper ring;

a bottom plate having a through slot penetrated therethrough along an up and down direction; and a plurality of connection rods each defining an upper end connected with the upper ring and a lower end connected with the bottom plate, the plurality of connection rods being spaced apart from each other along a circumferential direction of the mounting frame; and a hook disposed on an outer circumferential surface of the lens for catching the mounting frame so as to mount the lens on the mounting frame, the hook being inserted between adjacent connection rods so as to catch the upper ring.

2. The LED lamp as set forth in claim 1, wherein the mounting frame has a mounting cavity therein, and the lens is mounted in the mounting cavity.

3. The LED lamp as set forth in claim 2, wherein a bottom surface of the lens is spaced apart from a bottom wall of the mounting cavity by a predetermined distance.

4. The LED lamp as set forth in claim 2, wherein a groove is formed in a circumferential wall of a top end of the cavity, an upper end of the lens is upwardly extended out of the mounting cavity, and an outer circumferential edge of the upper end of the lens is fitted in the groove.

5. The LED lamp as set forth in claim 4, wherein the upper end of the lens has a flange extended along a radial direction and fitted in the groove.

6. The LED lamp as set forth in claim 1, wherein the hook is V-shaped.

7. The LED lamp as set forth in claim 1, wherein a plurality of the hooks are provided and evenly spaced apart from each other along a circumferential direction of the lens.

8. The LED lamp as set forth in claim 1, wherein the hook and the lens are integral with each other.

9. The LED lamp as set forth in claim 1, wherein the hook abuts against each of the adjacent connection rods.

10. The LED lamp as set forth in claim 1, wherein the hook catches a lower surface of the upper ring, wherein a contact surface of the hook contacting the lower surface of the upper ring, a bottom surface of the lens and the bottom plate are parallel with one another.

11. The LED lamp as set forth in claim 1, wherein the plurality of the connection rods, the upper ring and the bottom plate are integrally formed from a plastic material.

12. The LED lamp as set forth in claim 1, wherein a bottom wall of the cavity has a first wire hole penetrated therethrough in the up and down direction, wherein the bottom plate has a second wire hole penetrated therethrough in the up and down direction and is corresponded to the first wire hole, wherein a first wire groove is formed in an upper surface of the bottom plate communicated with the second wire hole.

13. The LED lamp as set forth in claim 12, wherein a column is disposed on a lower surface of the bottom plate and fitted within the first wire hole, and the second wire hole is penetrated through the column.

14. The LED lamp as set forth in claim 10, wherein a wire passing extension is disposed on an inner wall of the through slot and extended towards a center of the through slot, wherein a second wire groove is formed in an upper surface of the wire passing extension and communicated with the first wire groove.

15. The LED lamp as set forth in claim 12, wherein a holding groove is formed in the bottom wall of the cavity, a portion of the bottom plate is recessed downwardly with respect to a remaining portion of the bottom plate so as to form a first boss on a lower surface of the bottom plate and to form the first wire groove, a portion of the wire passing extension is recessed downwardly with respect to a remaining portion of the wire passing extension so as to form a second boss on a lower surface of the wire passing extension and to form the second wire groove, wherein the first boss and the second boss are received in the holding groove.

16. An LED lamp, comprising:

a heat radiation member defining a cavity therein;

an LED module disposed in the cavity;

a mounting frame disposed in the cavity and being above the LED module; and a lens mounted on the mounting frame, wherein the mounting frame has a mounting cavity therein, and the lens is mounted in the mounting cavity, a bottom surface of the lens is spaced apart from a bottom wall of the mounting cavity by a predetermined distance.

17. The LED lamp as set forth in claim 16, wherein a groove is formed in a circumferential wall of a top end of the cavity, an upper end of the lens is upwardly extended out of the mounting cavity, and an outer circumferential edge of the upper end of the lens is fitted in the groove.

18. The LED lamp as set forth in claim 17, wherein the upper end of the lens has a flange extended along a radial direction and fitted in the groove.

19. The LED lamp as set forth in claim 16, further comprising at least one hook disposed on an outer circumferential surface of the lens for catching the mounting frame so as to mount the lens on the mounting frame, wherein the hook is V-shaped.

20. The LED lamp as set forth in claim 19, wherein the at least one hook comprises a plurality of the hooks, which are evenly spaced apart from each other along a circumferential direction of the lens, wherein the plurality of hooks and the lens are integral with each other.

* * * * *